US008822918B2

(12) United States Patent
Taniguchi

(10) Patent No.: US 8,822,918 B2
(45) Date of Patent: Sep. 2, 2014

(54) ION GUIDE AND MASS SPECTROMETRY DEVICE

(71) Applicant: Shimadzu Corporation, Kyoto (JP)

(72) Inventor: Junichi Taniguchi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 13/890,577

(22) Filed: May 9, 2013

(65) Prior Publication Data

US 2013/0313421 A1 Nov. 28, 2013

(30) Foreign Application Priority Data

May 28, 2012 (JP) ..... 2012-120383

(51) Int. Cl.
*H01J 49/36* (2006.01)

(52) U.S. Cl.
USPC ..... 250/283; 250/281; 250/282; 250/290; 250/293

(58) Field of Classification Search
CPC ..... H01J 49/06; H01J 49/062; H01J 49/063
USPC ..... 250/281, 282, 283, 290, 293
See application file for complete search history.

(56) References Cited

U.S. PATENT DOCUMENTS 7,501,622 B2 * 3/2009 Kawato ..... 250/292
8,138,474 B2 * 3/2012 Wollnik et al. ..... 250/292
2005/0017194 A1 * 1/2005 Matsuya et al. ..... 250/396 R
2008/0035842 A1 * 2/2008 Sudakov et al. ..... 250/287
2009/0072136 A1 * 3/2009 Pringle et al. ..... 250/290
2009/0230301 A1 * 9/2009 Furuhashi et al. ..... 250/282
2011/0057094 A1 * 3/2011 Wollnik et al. ..... 250/281
2013/0075602 A1 * 3/2013 Stoermer ..... 250/283
2013/0240726 A1 * 9/2013 Hasegawa et al. ..... 250/288

FOREIGN PATENT DOCUMENTS

JP 2009-222554 A 10/2009
JP 2012-084288 A 4/2012

* cited by examiner

*Primary Examiner* — Michael Logie
(74) *Attorney, Agent, or Firm* — Sughrue Mion, PLLC

(57) ABSTRACT

An electrode changeover switch which switches the connection state of electrodes is provided in the wiring path between eight electrodes through, arranged rotation-symmetrically about ion optical axis, and voltage generation switch which generates square wave high voltage ±V. When switch is switched as shown in the drawing, two circumferentially adjacent rod electrodes are connected to form one set, a square wave voltage of opposite phase is applied to circumferentially adjacent sets, and an effectively quadrupole electric field is formed. When switch is switched, a square wave voltage of opposite phase is applied to circumferentially adjacent rod electrodes and an octupole electric field is formed. In this way, by switching the switch according to the mass range, etc., it becomes possible to rapidly switch the number of poles of a multipole electric field and to suitably transport ions.

14 Claims, 7 Drawing Sheets

Figure 1:
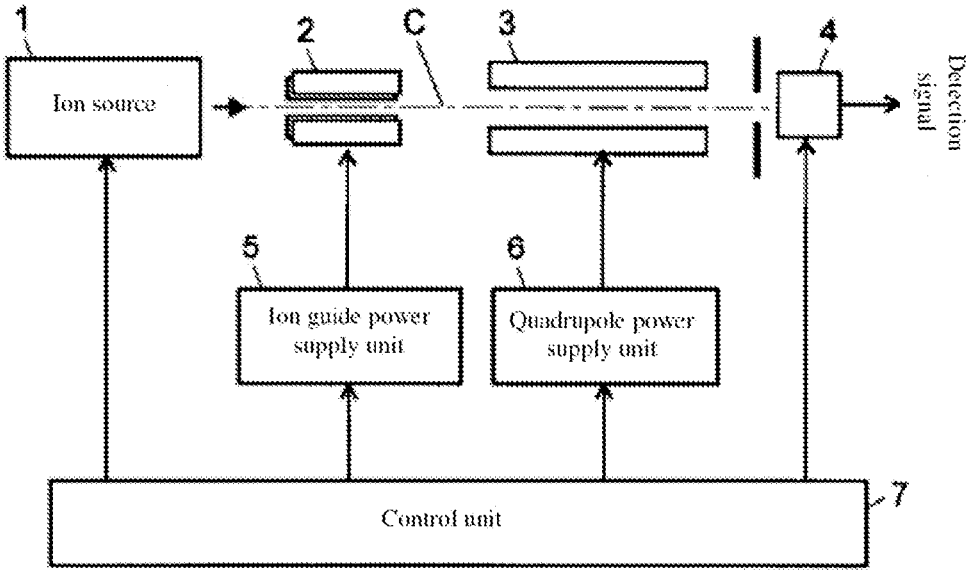

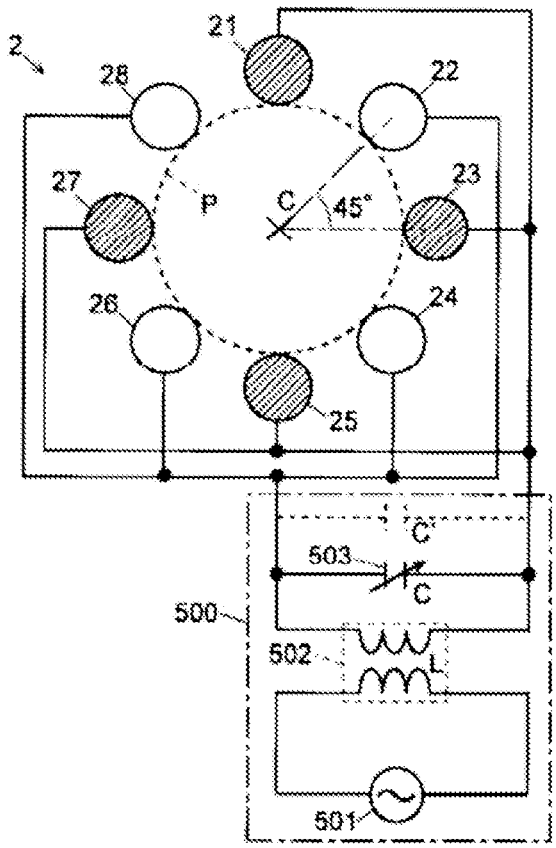
FIG. 7 - PRIOR ART
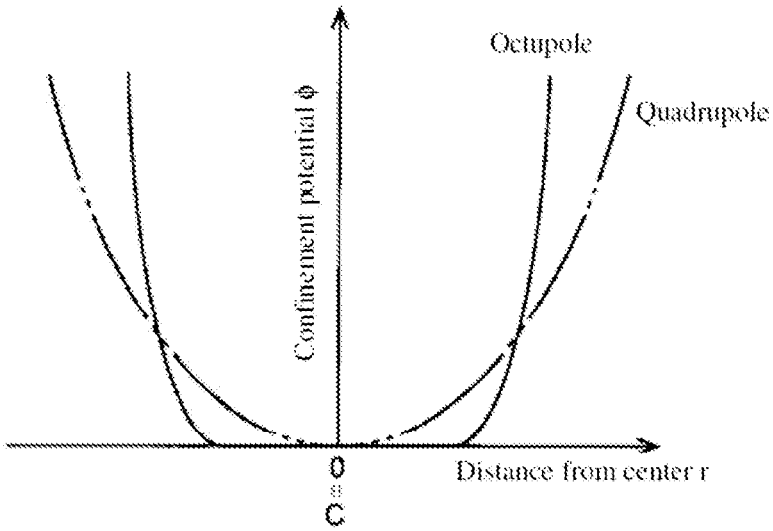
FIG. 8 - PRIOR ART

ION GUIDE AND MASS SPECTROMETRY DEVICE

TECHNICAL FIELD

The present invention relates to an ion guide which focuses ions and transports them to a subsequent stage, and to a mass spectrometry device using said ion guide.

BACKGROUND ART

To achieve high detection sensitivity in a mass spectrometry device, it is important for ions derived from sample components generated in an ion source to be fed into the mass spectrometer, such as a quadrupole mass filter, etc, as efficiently as possible. In particular, in mass spectrometry devices such as liquid chromatography-mass spectrometry device, where ionization is performed under atmospheric pressure, even under conditions of low vacuum atmosphere, i.e. when there are relatively many residual gas molecules, it is important to reduce the influence of scattering due to collision with such gas molecules as much as possible, and to transport ions to the mass spectrometer while minimizing losses. To achieve this objective, an ion optical element known as an ion guide is used for focusing the ions sent from the preceding stage and feeding them into the mass spectrometer, etc. of the next stage.

The general configuration of an ion guide is a multipole configuration in which 4, 6, 8 or more substantially round cylindrical rod electrodes are spaced apart from each other at the same angle and arranged in parallel to each other so as to surround the ion optical axis. In a multipole ion guide of this sort, normally, high frequency voltages of the same amplitude and frequency but of inverted phase are applied respectively to two rod electrodes adjacent in the circumferential direction about the ion optical axis. When this sort of high frequency voltage is applied to each rod electrode, pseudo-potential barriers are formed by the high frequency electric field generated between the electrodes, and ions are reflected between these potential barriers as they travel downstream. As a result, ions scattered due to collision with residual gas molecules can also be stably transported and the sensitivity of the device can be increased.

Quadrupole, hexapole and octupole configurations are commonly used for multipole ion guides. It is known that when the voltage applied to the rod electrodes is the same, the greater the number of poles, the greater the ion confinement potential in the vicinity of the rod electrodes. It is furthermore known that the ability to focus ions near the ion optical axis is higher when the number of poles is smaller. FIG. 8 is a drawing which schematically illustrates the relationship between radial distance r from the ion optical axis (center) and the confinement potential $\phi$ in a quadrupole ion guide and an octupole ion guide (see Patent literature 1, etc.).

It can be seen that in an octupole ion guide, the confinement potential rises sharply and the ion confinement capacity is higher at locations near the rod electrodes (away from the center). On the other hand, since the bottom of the potential well is wide, ions can be readily present not just near the ion optical axis but also at locations away from the optical axis. In other words, the degree of concentration of ions toward the vicinity of the ion optical axis is not particularly good. By contrast, with a quadrupole ion guide, the confinement potential rise is gradual, so the ion confinement capacity is relatively low, but the bottom of the potential well is limited to a narrow range in the vicinity of the ion optical axis, so ions are focused near the ion optical axis.

It will be noted that in a quadrupole ion guide, the confinement potential can be increased by increasing the amplitude of the high frequency voltage applied to each rod electrode, but a quadrupole ion guide has a low mass cutoff (LMC) limiting condition (see Patent literature 2, etc.), with the LMC increasing the more one raises the driving voltage. Thus, when driving voltage is raised in order to increase the confinement potential, the problem occurs that it becomes difficult to stably transport ions with a low mass-charge ratio, so there are limits to increasing the driving voltage.

Since the ion transport characteristics differ in this way between quadrupole ion guides and octupole ion guides, and also multipole ion guides with other numbers of poles, it is desirable to select an ion guides with the appropriate number of poles according to the conditions of use, such as the mass-charge ratio range of the ions to be analyzed. Specifically, when analyzing ions across a wide mass-charge ratio range, it is preferable to use to an octupole ion guide with high confinement capacity, and to detect ions with a specific mass-charge ratio or ions with a narrow mass-charge ratio range at high sensitivity, it is preferable to use a quadrupole ion guide, focus ions near the ion optical path and transport ions to the subsequent stage ion optical system at low loss. Because of this, in order to obtain good analysis results, it is desirable to be able to rapidly switch the effective number of poles of the multipole ion guide even during execution of liquid chromatography/mass spectrometry (LC/MS) or gas chromatography/mass spectrometry (GC/MS).

However, in conventional mass spectrometry devices, switching the effective number of poles as described above is difficult for the following reasons. Namely, the high frequency voltage applied to each rod electrode of the multipole ion guide requires an amplitude of approximately several hundred V, and to generate such a voltage, LC resonant circuits employing inductance and capacitance are generally used in the prior art. FIG. 7 is a simplified diagram showing the electrode configuration and driving circuit of a conventional octupole ion guide.

In FIG. 7, the eight rod electrodes 21 through 28 contained in ion guide electrode unit 2 are arranged so as to be inscribed into a virtual round cylindrical body P having the ion optical axis C at its center and so as to be spaced apart at equal angular intervals (45°) in the circumferential direction. Sets of four of these eight rod electrodes 21 through 28, consisting of every other one in the circumferential direction (rod electrodes 21, 23, 25 and 27; and rod electrodes 22, 24, 26 and 28) are electrically connected, and voltage from a power supply unit 500 is applied to each of these two electrode groups. Looking at the ion guide electrode unit 2 from the power supply unit 500, an electrostatic capacitance C' exists between circumferentially adjacent rod electrodes, and this electrostatic capacitance C' is connected in parallel to a variable capacitance capacitor 503 having a capacitance C. The LC resonant circuit, formed by this electrostatic capacitance C' and capacitance C of variable capacitance capacitor 503 and the inductance L of coil 502, increases the amplitude of the high frequency signal inputted from high frequency signal generating unit 501, which is then applied to the rod electrodes 21 through 28. The resonant frequency is fixed, and the capacitance C of the variable capacitance capacitor 503 is adjusted to match the resonant frequency $f_{LC}$ of the LC resonant circuit to a specific frequency f.

In FIG. 7, if four electrode pair sets are formed taking two circumferentially adjacent rod electrodes as one set, and the electrical connection is switched by a switching means such as an electromagnetic relay so that a high frequency voltage of reverse polarity is applied to circumferentially adjacent electrode pairs, a quadrupole electric field can be formed in the space surrounded by rod electrodes 21 through 28. That is, the effective number of poles can be switched from 8 to 4. However, when this sort of switching is performed, the electrostatic capacitance C' between the rod electrodes changes, and thus the resonant frequency $f_{LC}$ of the LC resonant circuit deviates from the specific frequency f and adequate amplification of amplitude becomes impossible. In other words, high speed switching as described above was not possible because the capacitance C of variable capacitance capacitor 503 needs to be readjusted in response to change in electrostatic capacitance C' between the rod electrodes in order to modify the effective number of poles. Furthermore, the switching itself was a very laborious operation and was not practical.

PRIOR ART LITERATURES (Patent literature 1) Japanese Unexamined Patent Application Publication 2009-222554

(Patent literature 2) Japanese Unexamined Patent Application Publication 2012-84288

SUMMARY OF THE INVENTION

The present invention was made in view of the aforementioned problem, its object being to provide an ion guide which makes it possible to favorably transport ions by forming multipole electric fields with different numbers of poles as appropriate to the mass-charge ratio range of the ions to be analyzed and the purpose of analysis even while analysis is being performed, and also to provide a mass spectrometry device comprising said ion guide.

Means for Solving the Problem

The present invention, which was made to resolve the aforementioned problem, is an ion guide which contains an electrode unit in which N (where N is an integer not less than 6) rod-shaped or plate-shaped electrodes are arranged so as to surround an ion optical axis and which transports ions to a subsequent stage while focusing the ions by the action of a high frequency electric field formed in the space surrounded by said N electrodes, characterized in that it comprises:

a) a voltage generating means which generates a first square wave voltage of predetermined frequency and predetermined amplitude and a second square wave voltage of opposite phase to said first square wave voltage as voltages for forming a high frequency electric field in the space surrounded by said N electrodes; and b) a connection switching means which has one or more sets of two or more circumferentially adjacent electrodes from among said N electrodes; and which allows switching between a first state in which 2M sets (where M is an integer not less than 2) each consisting of one or multiple electrodes are formed, and a second state in which 2L sets (where L is an integer not less than 3 and greater than M) each consisting of one or multiple electrodes are formed under the condition that when a set consisting of multiple electrodes is formed, those multiple electrodes are circumferentially adjacent electrodes; and which switches the electrical connection between electrodes of said voltage generating means and said electrode unit such that the first square wave voltage is applied to one and the second square wave voltage is applied to the other of the different circumferentially adjacent sets in both said first and second states.

In the ion guide according to the present invention, the connection switching means can be switch using a semiconductor switching element or a relay having metal contact points, but the former is more appropriate when switching is to be performed at high speed.

As a preferable mode of the ion guide according to the present invention, a configuration may be employed which allows switching such that, in said second state, all the sets consist of one electrode each, and in said first state, all the sets consists of P (where P is an integer not less than 2) circumferentially adjacent electrodes.

As another preferable mode of the ion guide according to the present invention, a configuration may be employed which allows switching such that, in said second state, all the sets consist of P circumferentially adjacent electrodes, and in said first state, all the sets consist of Q (where Q is an integer greater than P) circumferentially adjacent electrodes.

In both the aforesaid modes, the number of electrodes making up each set is equal in both the first and the second state. Furthermore, the same square wave voltage is applied to the electrodes making up the same set, so no potential gradient is produced in the space between those electrodes, and thus, these electrodes can be regarded as a single electrode in terms of the electric field. Consequently, in the aforesaid two modes, in both the first state and the second state, the square wave voltage applied to the electrodes forms a high frequency electric field, symmetrical about the ion optical axis in the plane orthogonal to the ion optical axis, in the space surrounded by the electrodes. Therefore, the ions introduced into the ion guide as a whole progress along the ion optical axis while oscillating in the vicinity of the ion optical axis due to the effect of the high frequency electric field.

Furthermore, upon switching between the first state and second state by the switching of the electrical connections of the connection switching means, the voltage applied to at least a portion of the electrodes changes from the first square wave voltage to the second square wave voltage, or the opposite. Since the number of sets arranged about the ion optical axis differs between the first set and the second set, the effective number of poles of the high frequency electric field is changed by the switching. Since the ion confinement capacity and the ability to focus ions toward the vicinity of the ion optical axis depend on the number of poles of the high frequency electric field, as described above, by switching the electrical connections so that the effective number of poles changes according to the mass-charge ratio range, etc. of the ions to be analyzed, it becomes possible as a whole to efficiently capture, and transport to the subsequent stage, ions across a wide mass-charge ratio range, or to particularly concentrate near the ion optical axis, and transport to the subsequent stage, ions in a narrow mass-charge ratio range.

With the ion guide according to the present invention, only the square wave voltage generated by the voltage generating means is switched when changing the effective number of poles of the high frequency electric field, as described above, so the switching is completed in a short time and an electric field corresponding to the voltage applied after switching is formed immediately after switching. Thus, it becomes possible to perform the switching in nearly real time even while an analysis is running, and to bring the ion non-sensing time accompanying the switching to nearly zero. Furthermore, the frequency and amplitude of the rectangular wave voltage generated by the voltage generating means are essentially unaffected by the electrodes which constitute the load, so the switching does not require any sort of accompanying adjustment.

With the ion guide according to the present invention, the N, M and L parameter values can take on arbitrary values subject to the respective restrictions. However, N, just like M and L, are usually even numbers. Furthermore, typically, 4M=2L=N, that is, it is preferable to enable switching such that, in the second state, all the sets consist of one electrode each, and in the first state, all the sets consist of two circumferentially adjacent electrodes.

Moreover, it is preferable if M=2, L=4 and N=8. In this case, the ion guide according to the present invention functions effectively either as a quadrupole ion guide or an octupole ion guide based on the switching of the connection by the connection switching means. As discussed above, when it functions as a quadrupole ion guide, the ion confinement capacity is low, but the confined ions are focused near the ion optical axis, which is useful for transporting ions having a specific mass-charge ratio or a relatively small amount of ions of a narrow mass-charge ratio range to the subsequent stage at low loss. On the other hand, when it functions as an octupole ion guide, the ion confinement capacity is high, which is useful for transporting a large amount of ions of a wide mass-charge ratio range to the subsequent stage.

Furthermore, with the ion guide according to the present invention, the shape of the high frequency electric field formed in the space surrounded by the electrodes can be made asymmetrical about the ion optical axis by making the number of electrodes making up each set nonuniform. It is thereby possible to displace the bottom of the pseudo-potential well from the central axis of electrode arrangement and to implement an off-axis ion optical system in which the ion optical axis of ions which enter the ion guide is offset from the ion optical axis of ions outputted from the ion guide. With the connection switching means, one can then rapidly switch between an off-axis ion optical system and a normal ion optical system in which the input axis and output axis are located on the same line, enabling differential use whereby, for example, under conditions where there are many neutral particles constituting noise, the off-axis ion optical system would be used, and under conditions where the neutral particles have hardly any influence, the normal ion optical system would be used.

Furthermore, a mass analysis device comprising an ion guide according to the present invention can be configured so as to comprise a control means which controls the switching of connections by the connection switching means according to the analysis conditions including the mass-charge ratio range of ions to be analyzed. With such a configuration, for example, in a case where scanning measurement across a predetermined mass-charge ratio range and SIM measurement targeting a particular mass-charge ratio are performed while switching over a short period of time, the ion guide according to the present invention can be made to function as a multipole ion guide suited respectively for scanning measurement and SIM measurement, allowing good analysis results to be obtained for both types of measurement.

The ion guide and mass spectrometry device according to the present invention make it is possible to favorably transport ions to the subsequent stage and obtain good analysis results by forming multipole electric fields with different numbers of poles as appropriate to the mass-charge ratio range of the ions to be analyzed and the purpose of analysis even while analysis is being performed.

BRIEF DESCRIPTION OF THE DRAWINGS (FIG. 1) A simplified diagram of a mass spectrometry device according to an example of embodiment of the present invention.

(FIG. 2) A diagram of the main parts in the case where an ion guide containing an electrode unit and power supply unit in the mass spectrometry device according to the present example of embodiment is made to function as an octupole ion guide.

(FIG. 3) A diagram of the main parts in the case where an ion guide containing an electrode unit and power supply unit in the mass spectrometry device according to the present example of embodiment is made to function as a quadrupole ion guide.

(FIG. 4) A waveform diagram of the square wave voltage applied to rod electrodes in the mass spectrometry device according to the present example of embodiment.

(FIG. 5) A diagram of the main parts of an ion guide in a mass spectrometry device according to another example of embodiment of the present invention.

(FIG. 6) A diagram of the main parts of an ion guide in a mass spectrometry device according to another example of embodiment of the present invention.

(FIG. 7) A simplified diagram showing the electrode configuration and driving circuit of a conventional octupole ion guide.

(FIG. 8) A schematic of the relationship between radial distance r from the ion optical axis (center) and the confinement potential $\phi$ in a quadrupole ion guide and octupole ion guide.

DETAILED DESCRIPTION OF THE EXEMPLARY EMBODIMENTS

A mass spectrometry device constituting an example of embodiment of the present invention (first example of embodiment) will be described below with reference to the appended drawings.

Figure 2:
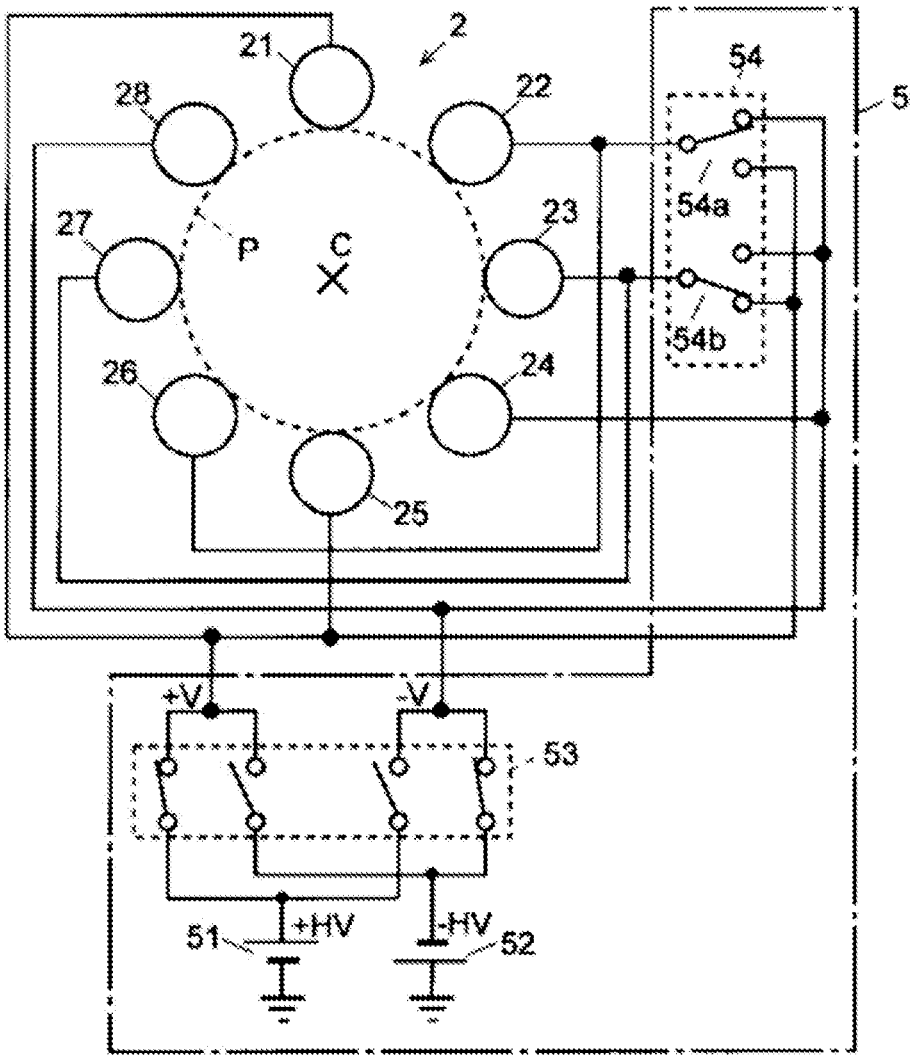
Figure 3:
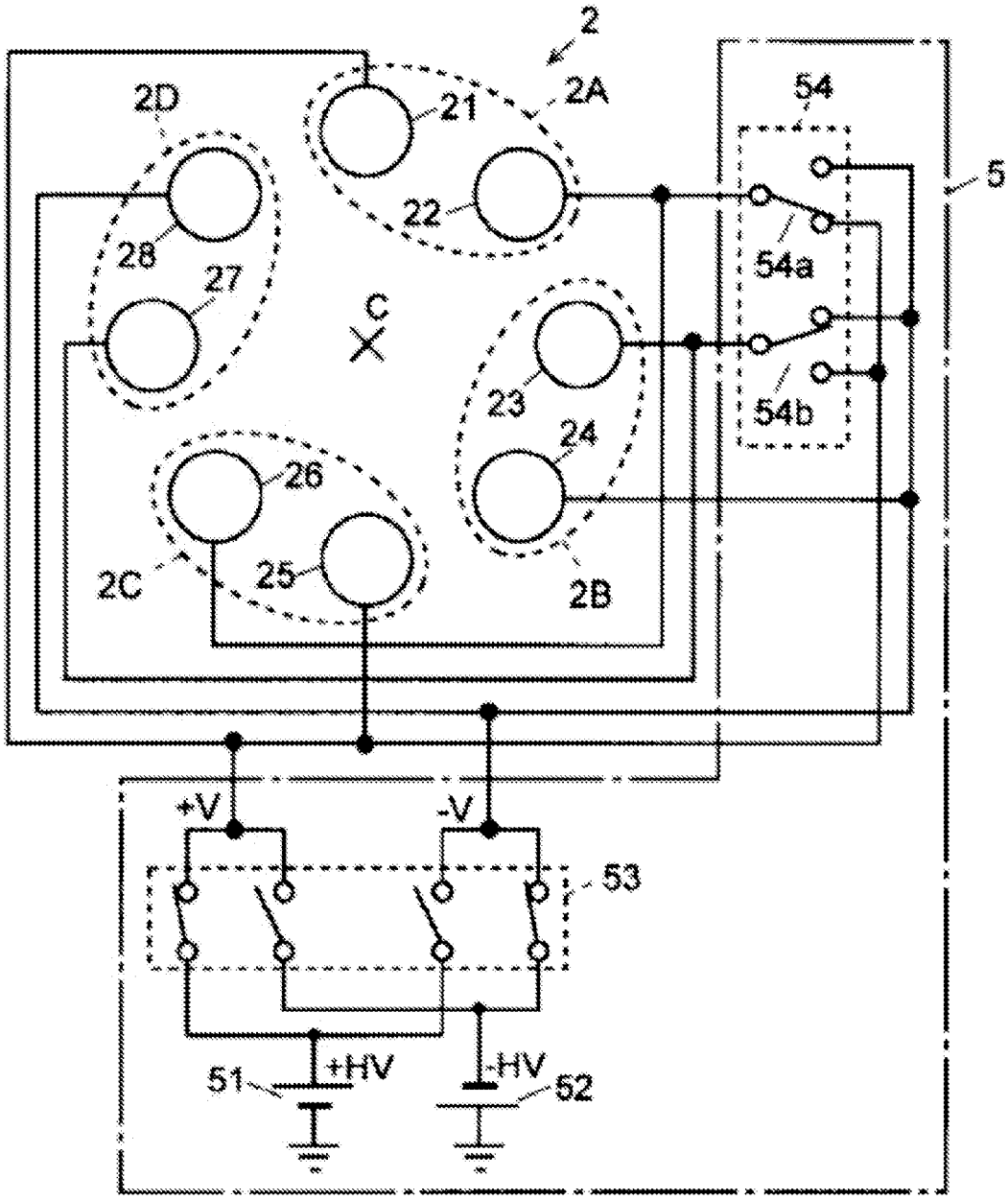
Figure 4:
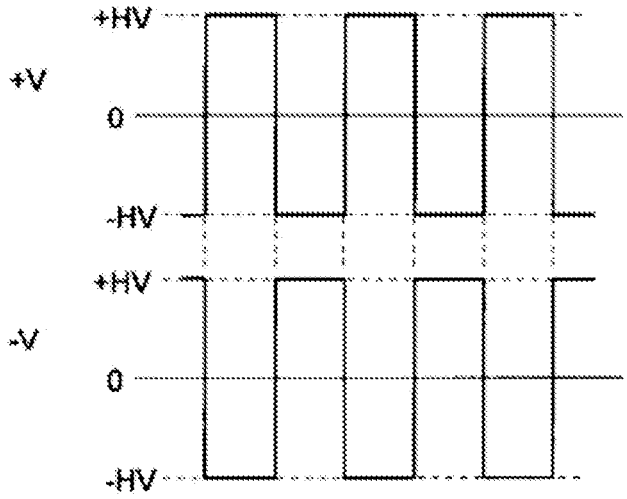

FIG. 1 is a simplified diagram of a mass spectrometry device according to a first example of embodiment; FIG. 2 is a diagram of the main parts in the case where an ion guide containing an electrode unit and power supply unit in the mass spectrometry device according to the present example of embodiment is made to function as an octupole ion guide; FIG. 3 is a diagram of the main parts in the case where the ion guide shown in FIG. 2 is made to function as a quadrupole ion guide; FIG. 4 is a waveform diagram of the square wave voltage applied to the rod electrodes.

As shown in FIG. 1, the mass spectrometry device of the present example of embodiment comprises, inside an unillustrated vacuum chamber, an ion source 1 which ionizes the sample components; an ion guide electrode unit 2 which focuses the ions generated in ion source 1 and feeds them to the subsequent stage; a quadrupole mass filter 3 which selectively allows the passage only of those ions transported by the ion guide electrode unit 2 which have a specific mass-charge ratio; and a detector 4 which detects ions which have passed through the quadrupole mass filter 3. Under the control of a control unit 7 containing a CPU, etc, ion guide power supply unit 5 applies a predetermined voltage to the rod electrodes contained in the ion guide electrode unit 2, and quadrupole power supply unit 6 applies a predetermined voltage to the rod electrodes contained in quadrupole mass filter 3.

When the sample to be analyzed is gaseous, an ion source 1 based on electron ionization (EI), chemical ionization (CI) or the like is used. If the sample to be analyzed is liquid, an ion source 1 based on electrospray ionization (ESI), atmospheric pressure chemical ionization (APCI) or the like is used. In this case, the ion source 1 is disposed not under vacuum but under atmospheric pressure, and a multistage differential evacuation system configuration is employed. Furthermore, when the sample to be analyzed is solid, an ion source 1 based on matrix assisted laser desorption ionization (MALDI) is used.

Furthermore, as the mass spectrometer, instead of a quadrupole mass filter, a time of flight mass spectrometer or other systems can also be used.

In the mass spectrometry device of the present example of embodiment, the ion guide comprising ion guide electrode unit 2 and ion guide power supply unit 5 has the function of feeding ions derived from sample ingredients produced in ion source 1 to the quadrupole mass filter 3 of the subsequent stage at high efficiency. However, there are cases where the ion guide is also given the action of removing ions and other particles which are not necessary for analysis. For example, if large amounts of sample solvent derived ions, which hinder analysis, are introduced into the quadrupole mass filter 3, they may cause contamination of the filter 3 or the like, and the function of removing (dispersing) such ions may be given to the ion guide.

In the present example of embodiment, the ion guide electrode unit 2, as shown in FIG. 2, consists of eight substantially round cylindrical rod electrodes 21 through 28 arranged in parallel to each other about a straight linear ion optical axis C and spaced apart at 45° rotational angle intervals. The rod electrodes 21 through 28 are inscribed into a virtual round cylindrical body P having the ion optical axis C as its central axis, and the arrangement of the rod electrodes 21 through 28 is rotationally symmetrical about the ion optical axis C. This arrangement is the same as the electrode arrangement of the conventional octupole ion guide shown in FIG. 7. It will be noted that the ion guide electrode unit 2 shown in FIG. 2 and FIG. 3 is a cross-sectional view cutting through the electrodes 21 through 28 in a plane orthogonal to ion optical axis C, similar to FIG. 7.

Ion guide power supply unit 5 contains a circuit which does not generate sinusoidal high voltage but rather generates square wave high voltage. Namely, ion guide power supply unit 5 comprises, as the voltage generating means of the present invention, a direct current positive power supply 51 with a voltage level of +HV, and direct current negative power supply 52 with a voltage level of −HV, and a voltage generation switch 53 which rapidly switches between voltage from the direct current positive power supply 51 and the voltage from the direct current negative power supply 52 to generate a first square wave voltage (+V) with an amplitude of 2 HV and a frequency f, and a second square wave voltage (−V) with the opposite phase thereto (phase displaced by 180°), as shown in FIG. 4. The individual switches making up the voltage generation switch 53 need to have high operating speed and high voltage resistance, so normally, semiconductor switching elements such as power MOSFETS are used for this purpose.

Ion guide power supply unit 5 further comprises, as the connection switching means of the present invention, an electrode changeover switch 54 which is inserted into the wiring path connecting the square wave voltage generating unit consisting of direct current positive power supply 51, direct current negative power supply 52 and voltage generation switch 53, to the rod electrodes 21 through 28. This electrode changeover switch 54 contains two 2-input/1-output switches 54*a*, 54*b*, one of which is used for application of first square wave voltage (+V) and the other for application of second square wave voltage (−V). This electrode changeover switch 54 can be fashioned using a semiconductor switching element, similarly to voltage generation switch 53, but in cases where high speed switching characteristics are not especially required, a relay having metal contact points may be used as well. The two 2-input/1-output switches 54*a*, 54*b* contained in the electrode changeover switch 54 perform interlocked switching such that when one selects the upper input, the other selects the lower input, as shown in FIG. 2 and FIG. 3.

Next, the operation of the ion guide with the above configuration will be described.

When one wishes to make this ion guide function as an octupole ion guide, the control unit 7 places the electrode changeover switch 54 into the state shown in FIG. 2. In this state, of the eight rod electrodes 21 through 28, four rod electrodes 22, 24, 26 and 28 are connected to each other through 2-input/1-output switch 54*a*, and four rod electrodes 21, 23, 25 and 27 are connected to each other via 2-input/1-output witch 54*b*. Namely, every other rod electrode around the ion optical axis C is connected to each other, just as in the electrode connection state shown in FIG. 7. The first square wave voltage (+V) is applied to one set of four rod electrodes 21, 23, 25, 27, and the second square wave voltage (−V), which has the same amplitude but the opposite phase, is applied to the other four rod electrodes 22, 24, 26, 28.

As a result, an octupole electric field is formed in the space surrounded by the eight rod electrodes 21 through 28, and ions introduced into this space are transported while being focused by the octupole electric field. The octupole electric field here has a shape symmetrical about the ion optical axis C, so the confinement potential in the diametric direction is as shown in FIG. 8. Namely, a large amount of ions can be stably sent to the subsequent stage due to high confinement capacity.

Furthermore, when one wishes to make this ion guide function as a quadrupole ion guide, the control unit 7 switches the electrode changeover switch 54 to the state shown in FIG. 3. In this state, of the eight rod electrodes 21 through 28, four rod electrodes 21, 22, 25 and 26 are connected to each other via 2-input/1-output switch 54*a*, and four rod electrodes 23, 24, 27 and 28 are connected to each other via 2-input/1-output switch 54*b*. Namely, as shown by the dotted line in FIG. 3, four sets 2A, 2B, 2C and 2D are formed, taking two circumferentially adjacent rod electrodes as one set, and the two sets 2A and 2C, and 2B and 2D, which face each other across the ion optical axis C, are connected to each other. A first square wave voltage (+V) is applied to the four rod electrodes 21, 22, 25 and 26 belonging to the first two sets 2A and 2C, and the second square wave voltage (−V) of the same amplitude but opposite phase is applied to the circumferentially adjacent four rod electrodes 23, 24, 27 and 28 belonging to the other two sets 2B and 2D.

The same square wave voltage is applied to two circumferentially adjacent rod electrodes belonging to the same set, so no potential difference is generated and no effective electric field is present between these two rod electrodes. Therefore, the two rod electrodes belonging to the same set can be virtually considered to be a single rod electrode, in which case there would be four virtual rod electrodes, and the configuration can be viewed as a quadrupole configuration in which a square wave voltage of reverse phase is applied to circumferentially adjacent virtual rod electrodes. As a result, a quadrupole electric field is effectively formed in the space surrounded by the eight rod electrodes 21 through 28, and the ions introduced into this space are transported while being focused by the quadrupole electric field. The quadrupole electric field here has a symmetrical shape centered on ion optical axis C, so the confinement potential in the diametric direction is as shown in FIG. 8. Namely, while the confinement capacity is inferior compared to the octupole configuration shown in FIG. 2, the majority of the trapped ions gather near the ion optical axis C, allowing ions to be fed more efficiently to the ion optical elements of the subsequent stage, such as the quadrupole mass filter 3.

When the connection state is switched by the electrode changeover switch 54, the electrostatic capacitance between circumferentially adjacent rod electrodes changes, but since the amplitude and frequency of the first and second square wave voltages (+V, −V) is not affected by such change in electrostatic capacitance, the ion guide can be made to function as a quadrupole or octupole starting immediately after switching. It is thus possible to switch the effective number of poles of the ion guide rapidly even during analysis, for example, allowing one to perform switching as appropriate to the mass-charge ratio range, etc. of the ions to be analyzed.

In the above-described first example of embodiment, an ion guide electrode unit 2 consisting of eight rod electrodes was made to operate as either an octupole or a quadrupole, but expansion to other multipole forms is also possible.

Figure 5:
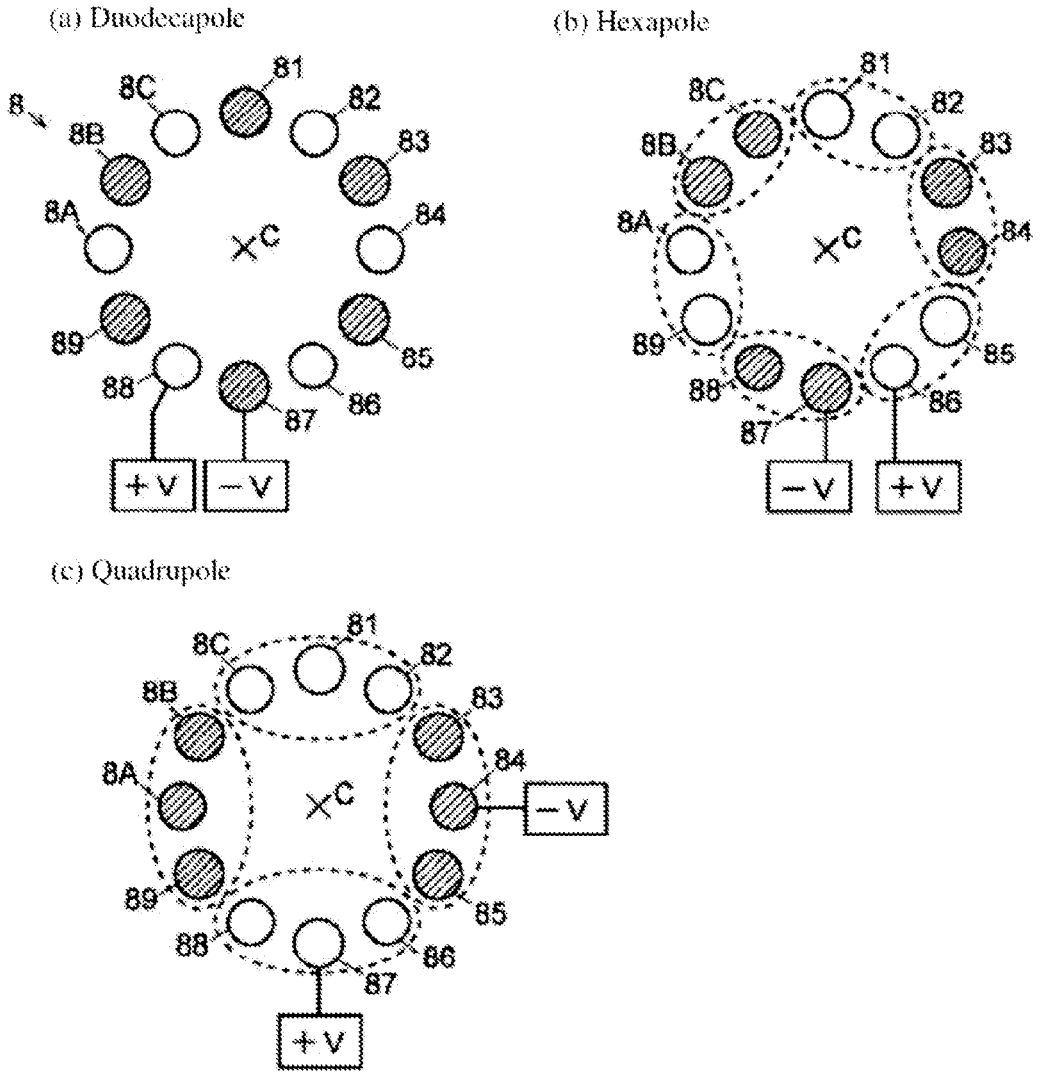

FIG. 5 is a simplified diagram of an ion guide in a mass spectrometry device according to another example of embodiment (second example of embodiment) of the present invention.

The ion guide power supply unit 8 in this second example of embodiment comprises 12 rod electrodes 81 through 8C arranged in a rotationally symmetrical fashion about the ion optical axis C. If every other rod electrode in the circumferential direction, i.e. rod electrodes 81, 83, 85, 87, 89, 8B and 82, 84, 86, 88, 8A, 8C are respectively taken as one set, a first square wave voltage (+V) is applied to one set, and a second square wave voltage (−V) is applied to the other set, as shown in FIG. 5(*a*), this will function as a duodecapole ion guide. If two circumferentially adjacent rod electrodes are taken as a set, a first square wave voltage (+V) is applied to one circumferentially adjacent set and a second square wave voltage (−V) is applied to the other, as shown in FIG. 5(*b*), this will function effectively as a hexapole ion guide. Furthermore, if three circumferentially adjacent rod electrodes as taken as a set, a first square wave voltage (+V) is applied to one circumferentially adjacent set and a second square wave voltage (−V) is applied to the other, as shown in FIG. 5(*c*), this will function effectively as a quadrupole ion guide. In this way, the configuration of the electrode changeover switch for changing between connection states of the rod electrodes 81 through 8C, although not illustrated, is obvious from the description given in the first example of embodiment.

In both the first and second examples of embodiment above, the generated multipole electric field is symmetrical about the ion optical axis C, and ions basically are most readily present near the ion optical axis C. This is due to the fact that the arrangement of the rod electrodes is rotationally symmetrical and that the number of rod electrodes of each set is made equal when multiple circumferentially adjacent rod electrodes are made into sets. By contrast, enabling the switching of the connection state so as to allow one to intentionally change the number of rod electrodes belonging to each set would make it possible to form multipole electric fields which are asymmetrical about the ion optical axis C and to thereby control the behavior of the ions.

Figure 6:
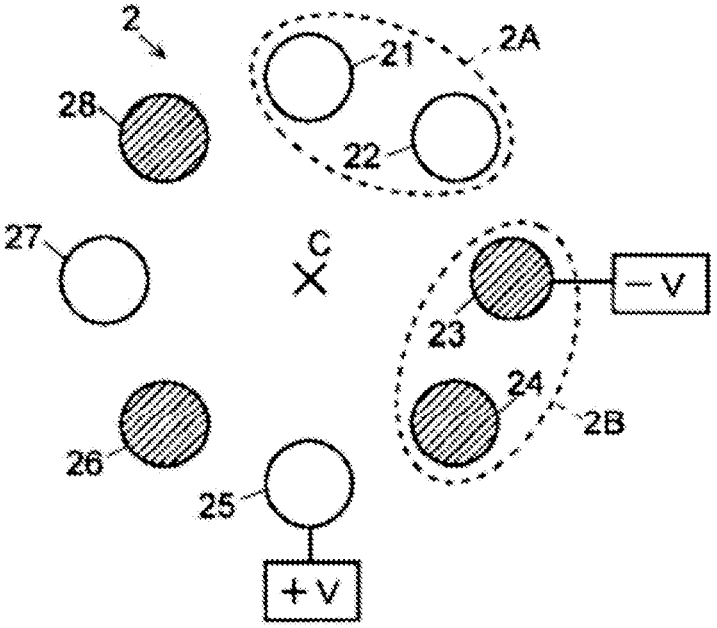

FIG. 6 is a simplified diagram of an ion guide in a mass spectrometry device according to another example of embodiment (third example of embodiment) of the present invention.

The ion guide electrode unit 2 in this third example of embodiment comprises eight rod electrodes 21 through 28 similar to the ion guide electrodes in the first example of embodiment above; however, two circumferentially adjacent rod electrodes 21, 22 and rod electrodes 23, 24 are each treated as one group, and the other four rod electrodes 25 through 28 are each individually treated as one group when switching with an unillustrated electrode changeover switch. For the six sets of virtual rod electrodes 2A, 2B, 25, 26, 27, 28 formed in this manner and containing one or two rod electrodes each, a first square wave voltage (+V) is applied to one and a second square wave voltage (−V) is applied to the other of two circumferentially adjacent sets of virtual rod electrodes. As a result, a hexapole electric field is formed in the space surrounded by the eight rod electrodes 21 through 28, and since the arrangement of the virtual rod electrodes is asymmetrical about the ion optical axis C, the shape of the electric field formed is also asymmetrical.

In this case, the center of the bottom of the confinement potential is not the ion optical axis C shown in FIG. 6. Namely, the ion optical axis in the space surrounded by the rod electrodes 21 through 28 of this ion guide is not at the location of symbol C in FIG. 6 but is offset from that location, and this ion guide constitutes an off-axis ion optical system in which the ion input optical axis and the ion output optical axis are not on the same line. Therefore, enabling switching between a connection state of rod electrodes as shown in FIG. 2 or FIG. 3 and a connection state of rod electrodes as shown in FIG. 6 makes possible the switching between an off-axis ion optical system and a regular ion optical system which is not off-axis (where the ion input optical axis and ion output optical axis are location on the same line).

An off-axis ion optical system makes it possible to separate neutral particles which are unaffected by electrical fields from ions and remove them. Here, as one example, separate mass spectrometers are provided at the location where ions are outputted when the ion guide is operated as an off-axis ion optical system and at the location where ions are outputted when the ion guide is operated as a normal ion optical system. Then, by switching what mass spectrometer is used to perform mass spectrometry according to the purpose of analysis, the analysis conditions, etc., differential use becomes possible, whereby, under conditions with many neutral particles, etc., such particles are removed by axis offset to perform analysis at a high SN ratio, and under conditions where there are few neutral particles and the like, ions are efficiently fed into the mass spectrometer and analysis is performed at high sensitivity without performing axis offset. Furthermore, a configuration may be employed wherein the mass spectrometer is shared, and when the ion guide is operated as an off-axis ion optical system, the outputted ions are guided into the shared mass spectrometer through an ion transport tube, etc.

Furthermore, all the above examples of embodiment are merely examples of the present invention, and it is obvious that suitable modifications, corrections and additions within the gist of the present invention are included within the scope of patent claims of the present application. For example, it is obvious that the ion guide according to the present invention can be used not only in cases where ions are fed to a mass spectrometer such as a quadrupole mass filter, but also in cases where ions are fed to a collision cell in a tandem quadrupole mass spectrometry device and in cases where ions are fed to a three-dimensional quadrupole ion trap in an ion trap mass spectrometry device (or ion trap time of flight mass spectrometry device) and the like.

DESCRIPTION OF REFERENCES

1 . . . ion source
2, 8 . . . ion guide electrode unit
21, 22, 23, 24, 25, 26, 27, 28, 81, 82, 83, 84, 85, 86, 87, 88, 89, 8A, 8B, 8C . . . rod electrode
2A, 2B, 2C, 2D . . . virtual rod electrode
3 . . . quadrupole mass filter

4 . . . detector
5 . . . ion guide power supply unit
51 . . . direct current positive power supply
52 . . . direct current negative power supply
53 . . . voltage generation switch
54 . . . electrode changeover switch
54*a*, 54*b* . . . 2-input/1-output switch
6 . . . quadrupole power supply unit
7 . . . control unit
8 . . . ion guide electrode unit
C . . . ion optical axis

What is claimed is:

1. An ion guide, comprising:

a) an electrode unit including a number N (where N is an integer not less than 6) of rod-shaped or plate-shaped electrodes arranged so as to surround an ion optical axis, the electrode unit transports ions to a subsequent stage while focusing ions by action of a high frequency electric field formed in a space surrounded by said N electrodes, b) a voltage generator configured to generate a first square wave voltage of predetermined frequency and predetermined amplitude and a second square wave voltage of opposite phase to said first square wave voltage as voltages for forming the high frequency electric field in the space surrounded by said N electrodes; and c) a connection switch configured to switch the electrode unit between a first state and a second state;

wherein in the first state, the electrodes are grouped in a number 2M of sets (where M is an integer not less than 2), and in the second state, the electrodes are grouped in a number 2L of sets (where L is an integer not less than 3 and greater than M);

in both said first and second states, each of the sets includes either only one of the electrodes or a plurality of circumferentially adjacent electrodes electrically connected to one another; and the connection switch causes an electrical connection to be established between electrodes of said voltage generator and said electrode unit such that the first square wave voltage is applied to one of the sets and the second square wave voltage is applied to another of the sets which is circumferentially adjacent to the one of the sets.

2. The ion guide as described in claim 1, wherein in said second state, all of the sets consist of one electrode each, and in said first state, all of the sets consist of a number P (where P is an integer not less than 2) of circumferentially adjacent electrodes.

3. The ion guide as described in claim 2, wherein 4M=2L=N.

4. The ion guide as described in claim 3, wherein M=2, L=4, and N=8.

5. A mass spectrometry device, comprising the ion guide as described in claim 4, a control unit which controls the switching of connections by said connection switch according to analysis conditions including the mass-charge ratio range of the ions to be analyzed.

6. A mass spectrometry device, comprising the ion guide as described in claim 3, and a control unit which controls the switching of connections by said connection switch according to analysis conditions including the mass-charge ratio range of the ions to be analyzed.

7. A mass spectrometry device, comprising the ion guide as described in claim 2, and a control unit which controls the switching of connections by said connection switch according to analysis conditions including the mass-charge ratio range of the ions to be analyzed.

8. The ion guide as described in claim 1, wherein in said second state, all of the sets consist of a number P of circumferentially adjacent electrodes, and in said first state, all of the sets consist of a number Q (where Q is an integer greater than P) of circumferentially adjacent electrodes.

9. The ion guide as described in claim 8, wherein 4M=2L=N.

10. The ion guide as described in claim 9, wherein M=2, L=4, and N=8.

11. A mass spectrometry device comprising, the ion guide as described in claim 10, a control unit which controls the switching of connections by said connection switch according to analysis conditions including the mass-charge ratio range of the ions to be analyzed.

12. A mass spectrometry device comprising, the ion guide as described in claim 9, a control unit which controls the switching of connections by said connection switch according to analysis conditions including the mass-charge ratio range of the ions to be analyzed.

13. A mass spectrometry device, comprising the ion guide as described in claim 8, and a control unit which controls the switching of connections by said connection switch according to analysis conditions including the mass-charge ratio range of the ions to be analyzed.

14. A mass spectrometry device, comprising the ion guide as described in claim 1, and a control unit which controls the switching of connections by said connection switch according to analysis conditions including the mass-charge ratio range of the ions to be analyzed.

* * * * *